United States Patent [19]

Arima

[11] Patent Number: 4,954,848

[45] Date of Patent: Sep. 4, 1990

[54] CONTROL APPARATUS FOR A TWO-SIDED/MULTIPLE COPY CONVEYING UNIT

[75] Inventor: Tatsunori Arima, Sagamihara, Japan

[73] Assignee: Kabushiki Kaisha Toshiba, Kawasaki, Japan

[21] Appl. No.: 353,554

[22] Filed: May 18, 1989

[30] Foreign Application Priority Data

May 18, 1988 [JP] Japan ..... 63-119207

[51] Int. Cl.[5] ..... G03G 21/00

[52] U.S. Cl. ..... 355/319; 355/204; 355/316

[58] Field of Search ..... 355/319, 206, 318, 205, 355/204, 316

[56] References Cited

U.S. PATENT DOCUMENTS

| | | | |
|---|---|---|---|
| 4,206,995 | 6/1980 | Legg | 355/316 X |
| 4,515,465 | 5/1985 | Miyoshi et al. | 355/206 |
| 4,627,711 | 12/1986 | Schron | 355/316 X |
| 4,684,235 | 8/1987 | Kohmoto et al. | 355/206 X |
| 4,843,437 | 6/1989 | Hamano | 355/206 |
| 4,849,786 | 7/1989 | Murakami | 355/319 X |

*Primary Examiner*—A. T. Grimley
*Assistant Examiner*—Sandra L. Hoffman
*Attorney, Agent, or Firm*—Foley & Lardner, Schwartz, Jeffery, Schwaab, Mack, Blumenthal & Evans

[57] ABSTRACT

A sheet having an image of a document formed by a copying unit on one side is sequentially stacked in a stacking section of a two-sided/multiple copy unit. Such sheets are picked up by pick-up rollers one by one and conveyed to the copying unit by a plurality of conveying rollers which are arranged along a conveying path. A detection switch is provided on the conveying path to detect abnormality which may occur during conveyance of the sheet. If such abnormality is detected by the switch, then a door is opened by the operator and a caught sheet is removed from the rest of the machine. Upon the closure of the door, the door switch detects that the door is closed. At this time, the sheet is picked up from the stacking section by the pick-up roller prior to a copying operation by the copying unit and conveyed past a conveying path to a location near the copying unit. When a start-to-copy instruction is supplied to an operation panel, the sheet which is stopped near the copying unit is supplied to the copying unit where a document image is copied on the sheet.

7 Claims, 5 Drawing Sheets

CONTROL APPARATUS FOR A TWO-SIDED/MULTIPLE COPY CONVEYING UNIT

BACKGROUND OF THE INVENTION

1. Field of the Invention

The present invention relates to a copying machine capable of automatically copying an image on each side of a copying sheet or a plurality of images on one side of a copying sheet, and in particular an improved control unit for a two-sided/multiple copy conveying unit for conveying a copying sheet with an image formed on one side.

2. Description of the Related Art

A copying machine capable of automatically copying a document image on each side of a copying sheet or a plurality of document images on one side of a copying sheet has been developed in this art. This copying machine comprises a copying section for copying an image corresponding to a document image on a sheet, a stacking section for stacking those imaged sheets from the copying section and a conveying unit which, in the case of a two-sided copy mode, conveys the stacked sheet to the copying section in an "inverted" state and, in the case of a multiple copy mode, conveys the stacked sheet to the copying sheet in an non-inverted fashion.

In the aforementioned copying machine, in the two-sided copy mode, a document image is transferred to one side of the sheet at the copying section and conveyed to the stacking section. Then the imaged sheet is taken out of the stacking section and transferred to the copying section in an "inverted" fashion where, for example, another document image is transferred to that side of the sheet.

In the multiple copying mode, a document image is transferred to a half of one side of the sheet and then conveyed to the stacking section. The stacked sheet is conveyed, in that posture, via the conveying unit to the copying section where, for example, another document image is transferred to the remaining half of the sheet.

For the two-sided copy or multiple copy mode, the sheet which is taken out of the stacking section is once stopped at the conveying unit. The sheet thus stopped is responsive to the copying operation of the copying section to be transferred to the copying section. In the copying machine, however, when a plurality of copying sheets are imaged in a continuous copying mode, if the sheet which is taken out of the stacking section is jammed or caught at the location of the conveying unit, the copying operation is stopped until the cause of the jamming is removed. When, in this case, a start-to-copy instruction is issued from an operation panel in the copying machine after the jammed sheet has been removed, the succeeding sheet is taken out of the stacking section and, in this way, a copying operation is started.

In this way, after the interruption of the copying section, the sheet is being held in the stacking section, leaving a long distance from the stacking section to the copying section. For this reason, a long time is taken from the picking up of the sheet from the stacking section subsequent to the issuance of the start-to-copy instruction to the conveyance of the sheet to the copying section. It takes a long time to start a copying operation at the location of the copying section.

SUMMARY OF THE INVENTION

It is accordingly the object of the present invention to provide a control apparatus for a conveying unit which can shorten a time required to execute an initial copying operation after an image formation operation has been interrupted.

The object of the present invention is achieved by a control apparatus for a conveying unit which stacks once-image-formed sheets in stacking means and conveys the sheet in the stacking means to image forming means via a conveying path, the control apparatus comprising first detecting means for detecting a paper flow abnormality during conveyance of a sheet via the conveying path, second detecting means for detecting a release of the abnormality which is detected by the first detecting means, and means for, when the release of the abnormality is detected by the second detecting means, conveying the sheet in the stacking means to the proximity of the image forming means prior to forming an image on the sheet by the image forming means.

According to the present invention, even if an abnormality occurs during conveyance of the sheet and an image formation process is interrupted, until the image forming means is brought back to an operable state, a preceding sheet is conveyed to a location near to the image forming means in readiness for a copying operation to be continued, thereby shortening a time from the interruption of the image formation operation to the copying operation of the preceding sheet.

DETAILED DESCRIPTION OF THE PREFERRED EMBODIMENT

One embodiment of the present invention will be explained below with reference to the accompanying drawings.

Figure 1:
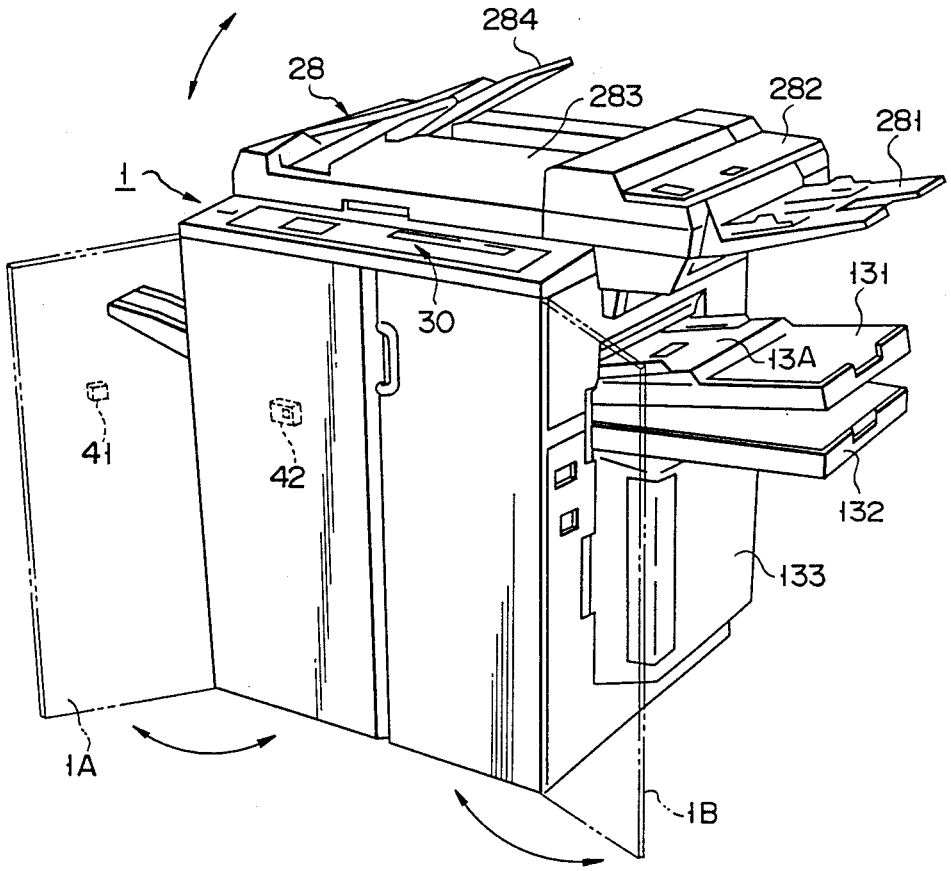
FIG. 1 is an external perspective view showing a copying machine according to one embodiment of the present invention.
Figure 2:
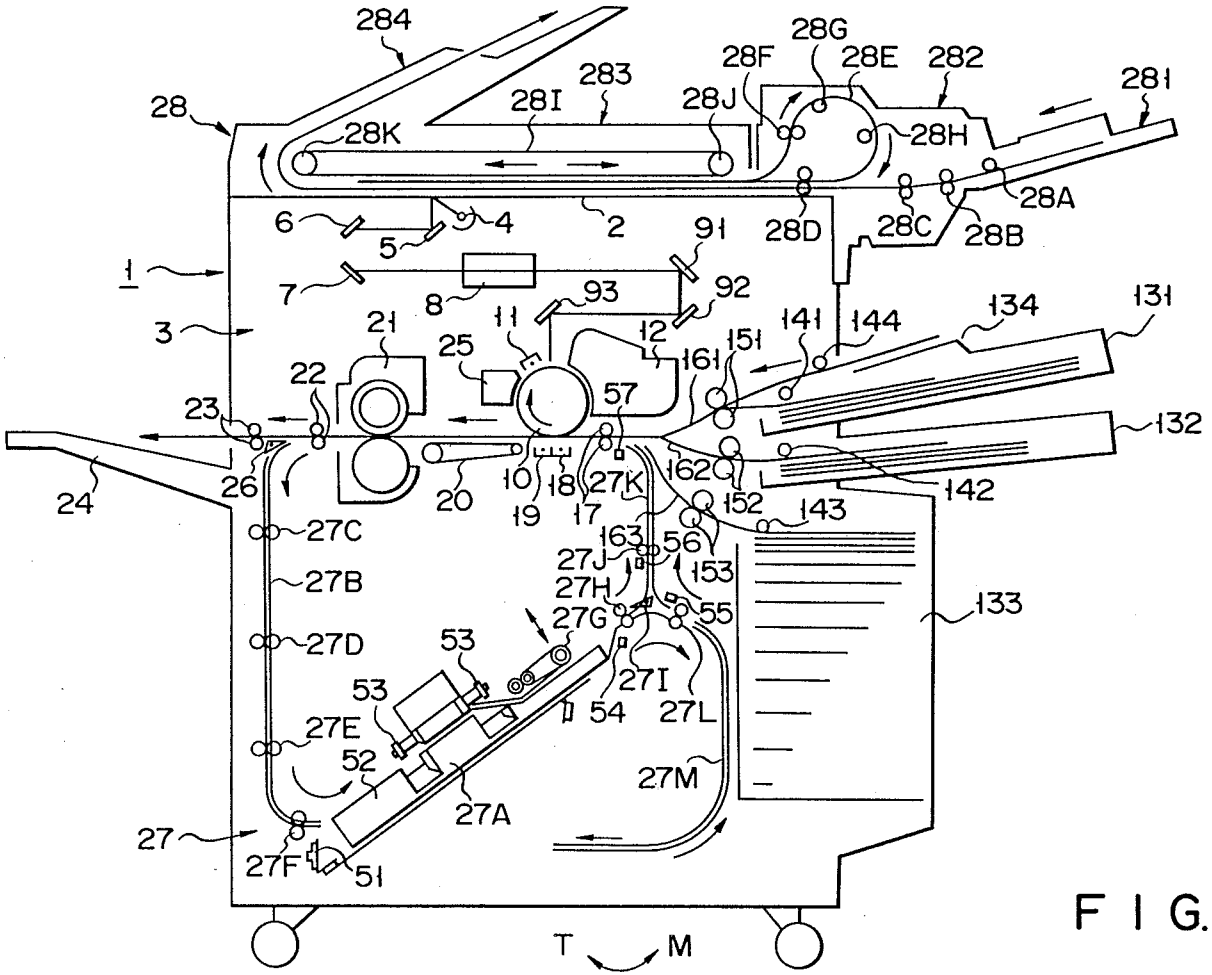
FIG. 2 is a cross-sectional view schematically showing an arrangement of the copying machine shown in FIG. 1.

In FIGS. 1 and 2, an auto document feeder 28 is provided on the top surface of a body 1 of a copying machine to automatically feed a document sheet to a document table 2. The feeder 28 is swingable relative to the body 1 as indicated by arrows in FIG. 1.

The body 1 comprises a copying unit 3 and a two-sided/multiple copy unit 27 which is located below the copying unit 3. The copying unit 3 is adapted to copy a document image to a copying sheet. The two-sided/-multiple copy unit 27 stacks the imaged sheet which is delivered from the copying unit 3, picks up sheets one by one from a stacking section 27A, and supplies the picked-up sheet to the copying unit 3 in an "inverted" or "noninverted" state in accordance with a two-sided or multiple copy mode.

Doors 1A and 1B are provided on the side of the machine body to cover the copying unit 3 and two-sided/multiple copy unit 27. The door 1A and 1B can be opened and closed in the directions as indicated by arrows in FIGS. 1A and 1B. A door-switch 42 constructed of, for example, a microswitch is provided within the machine body 1 at a location corresponding to the door 1A and adapted to detect the opened and closed states of the door 1A. A pushing member 41 for pushing the door switch 42 is provided on the inner surface of the door 1A.

The document table (transparent glass) 2 is located on the top surface of the copying unit 3 to place a document thereon. An optical system comprising an exposure lamp 4 and mirrors 5, 6 and 7 is provided below the document table 2. The optical system is moved along the document table 2 to allow the document to be scanned with exposure light emitting from the exposure lamp 4. Upon scanning the document with the exposure light the mirrors 6 and 7 are moved at one half the velocity of the mirror 5 to maintain an optical length. A beam, reflected back from the document in accordance with the scanning of the exposure light, is conducted to a photosensitive drum 10 via lenses 5, 6 and 7, magnification-changing lens block 8 and mirrors 91, 92 and 93.

The photosensitive drum 10 is rotated in a direction as indicated by an arrow C in FIG. 1 and has its surface charged by a charger 11. Then a document image is slit-exposed to form an electrostatic image on the surface of the photosensitive drum 10. The latent image formed on the drum 10 is toner-deposited by a developing unit 12 into a visual representation.

Sheets are stored in sheet cassettes 131 and 132 and large-capacity cassette 133, and a manual feed section 134 for manual insertion of a document is provided in the sheet feed cassette 131. Feed rollers 144, 141, 142 and 143 are provided near the sheet feed cassette 133 and sheet feed rollers 131, 132 and 133, respectively By one of the feed rollers 144, 141, 142 and 143, the sheet is fed from the manual feed section 134 or feed cassettes 131, 132 or 134. The sheet thus fed is conducted, by a corresponding pair of rollers of a plurality of pairs of rollers 151, 152 and 153, past a corresponding one of sheet guide paths 161, 162 and 163 to a pair of resist rollers 17. The pair of resist rollers 17 is fed to a transfer section which is situated between the photosensitive drum 10 and a charger 18 for transfer.

The sheet which is sent to the transfer section is brought into intimate contact with the surface of the photosensitive drum 10, allowing a toner image which is deposited on the photosensitive drum 10 to be transferred to the sheet by the charger 18. The image-transferred sheet is separated from the photosensitive drum 10 by a discharger 19 for separation and then conveyed by a belt conveyor 20 to a fixing roller (fixing unit) 21 where a toner image is fixed to the sheet. The image-fixed sheet is delivered past a pair of rollers 22 and pair of rollers 23 to a tray 24 provided outside the machine body 1.

Subsequent to transferring the toner image to the sheet, the photosensitive drum 10 has its residual toner removed by a cleaner 25, thus regaining an initial state.

As shown in FIG. 2, a sorting gate 26 is provided at a location between the delivery rollers 22 and 23. For an ordinary copy mode, the sorting gate 26 guides the toner image-fixed sheet toward the tray 24 whereas for a two-sided/multiple copy mode the toner image-fixed sheet is guided toward the two-sided/multiple copy unit 27.

The two-sided/multiple copy unit 27 is employed to copy an image on each side of a copying sheet or a plurality of images on one side of a copying sheet in which case the large-capacity sheet feed cassette 133 is provided at the two-sided/multiple copy unit 27.

A conveying path 27B is provided in the two-sided/-multiple copy unit 27 to guide the sheet which is guided by the sorting gate 26 into the stacking section 27A. A plurality of pairs of conveying rollers 27C, 27D, 27E and 27F are provided at predetermined intervals on the conveying path 27B.

A pick-up roller 27G is provided at the stacking section 27A to pick up the sheet from the stacking section 27A. The pick-up roller 27G is movable in the direction as indicated by arrows in FIG. 2 in accordance with the thickness of the stacked sheets. A length guide 51 and side aligning rollers 53 and 53 are provided at the location of the stacking section 27A. The length guide 51 is movable in accordance with the length of the stacked sheet, that is, the length of the sheet extending in the conveying direction The side aligning rollers 53 and 53 pushes the sheet which enters the stacking section 27A against a width guide 52 to place the sheet in an aligned state.

The sheets which are picked up by the pick-up roller 27G are separated one by one and guided past a pair of separation rollers 27 to a control gate 27I. For the multiple copy mode, the control gate 27I is swung in the direction as indicated by an arrow M in FIG. 2 and the sheet which is picked up from the stacking section 27A is guided via a pair of conveying rollers 27J and conveying path 27K into the resist roller 17. For the two-sided copy mode, the sheet is conveyed as indicated in FIG. 2, that is, the sheet which is picked up from the stacking section 27A is guided via a pair of rollers 27L into an inverting section 27M. When the sheet enters the inverting section 27M, the control gate 27I is swung in a direction as indicated by an arrow T and the sheet which is fed by a pair of conveying roller 27L is guided into the pair of resist rollers 17 via the pair of conveying rollers 27J and conveying path 27K.

Passage detection switches 54, 55, 56 and 57 for detecting the passage of the sheet are provided in proximity to the conveying path 27K in which case the passage detection switches 55 and 56 are jam detection switches for detecting jamming of the sheet.

The aforementioned auto document feeder 28 is provided above the machine body 1 and comprises a document feed rest 281, feed section 282, conveying section 282 and document delivery tray 284. The document is set on the document feed rest 281. The feed section 282 takes out the document sheets one by one from the document feed rest 281 and inverted. The conveying section 283 conveys the document sheet which is taken by the feed section 282 out of the document feed rest 281 or which is inverted onto the document table 2 such that the feed section 282 covers the document table. The document delivery tray 284 is located on the conveying section 283 and delivers a document sheet after it has been copied.

The feeding section 282 includes a take-out roller 28A for taking out the document sheet as set on a document feed rest 281, pairs of conveying rollers 28B, 28C and 28D for conveying the sheet onto the conveying section 283, inversion conveying path 28E which sets the document sheet on the document rest and guides that sheet after it has been copied on one side, and conveying rollers 28F, 28G and 28H located along the inversion conveying path 28E.

In the conveying section 283 is provided a belt 28I for conveying the document sheet which is supplied from the feeding section 282 onto a set position on the document table. The belt 28I is run between one roller 28J and the other roller 28K. The belt 28I delivers a copied sheet onto the document delivery tray 284, while, on the other hand, that sheet once copied on one side is conveyed past the inversion conveying path 28E so that it is again set on the document table for the other side of the sheet to be copied.

Figure 3:
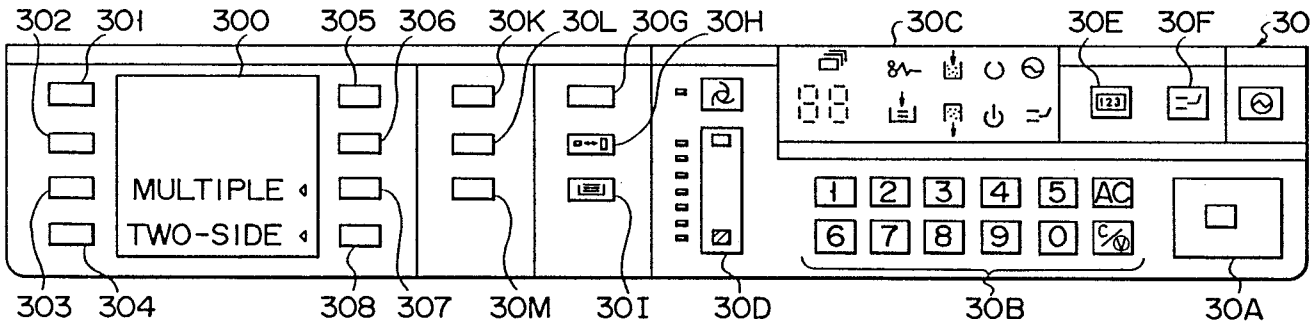
FIG. 3 is a plan view showing an operation panel of the copying machine of FIG. 1.

FIG. 3 shows an operation panel 30 which is provided on the machine body 1. The operation panel 30 includes a copying key 30A for generating an image formation signal for instructing a start of copying; ten keys 30B for setting the number of sheets to be copied; a display section 30C for displacing the operation state of respective parts or portions, jamming of sheets, etc.; a density setting portion 30D for setting a copying density; a count instruction key 30E for displaying, for example, a total number of sheets; an interruption key 30F adapted to be operated by another person during a copying operation; an equal-size key 30G for setting a copying magnification to an equal size (100%); a magnification setting key 30H for setting a copy magnification; a cassette select keys 30I for selecting the sheet feed cassettes 131, 132 and 133; a mode memory key 30K for storing various information in memory and reading the information out of the memory; and an information key 30L operated when information corresponding to a respective mode is to be obtained, noting that, if the key 30L is operated when there occurs jamming of the sheet for instance, information for releasing the "sheet jamming" is displayed on a display unit 300 as will be set forth below A function check key 30M checks the function now being set. The function check key 30M, upon being operated, can display a function "now being set" on the display unit 300.

The display unit 300 is, for example, of an LC (liquid crystal) dot matrix panel type and displays, for example, the functions set in the copying machine, in the form of characters. Upon operation of the various kinds of keys 30E, 30F, 30G, 30H, 30I, 30K, 30L and 30M, the corresponding display information is displayed on the display unit 300. Furthermore, if, for example, the jamming of the sheet occurs during the copying operation, then the display unit 300 displays the jamming position and course of action against it in the form of characters and figures. The display unit 300 includes operation keys 301 to 304 at one side and operations keys 305 to 308 at the other side, all of these keys being operated to select the various functions. In the state shown in FIG. 3, for example, the machine body 1 is set to the multiple copy mode upon the operation of the operation key 307 and to the two-sided copy mode upon the operation of the operation key 308.

Figure 4:
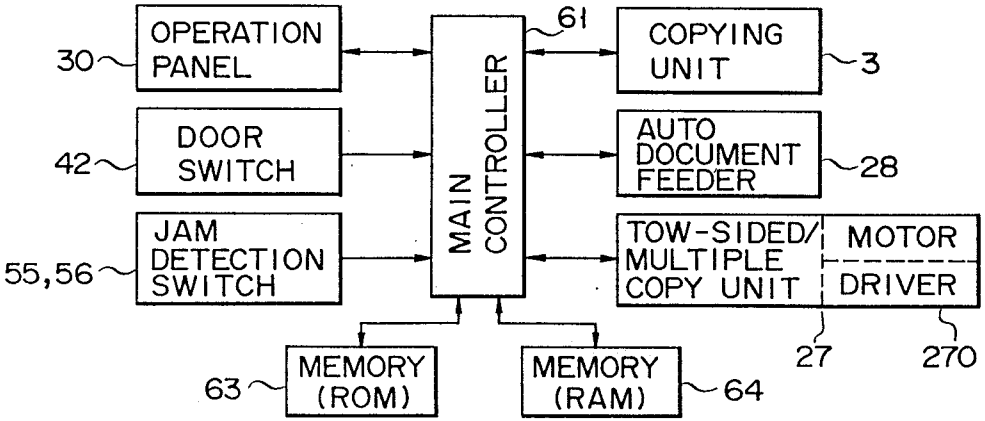
FIG. 4 is a schematic diagram showing a major portion of a control system of the copying machine.
Figure 5A:
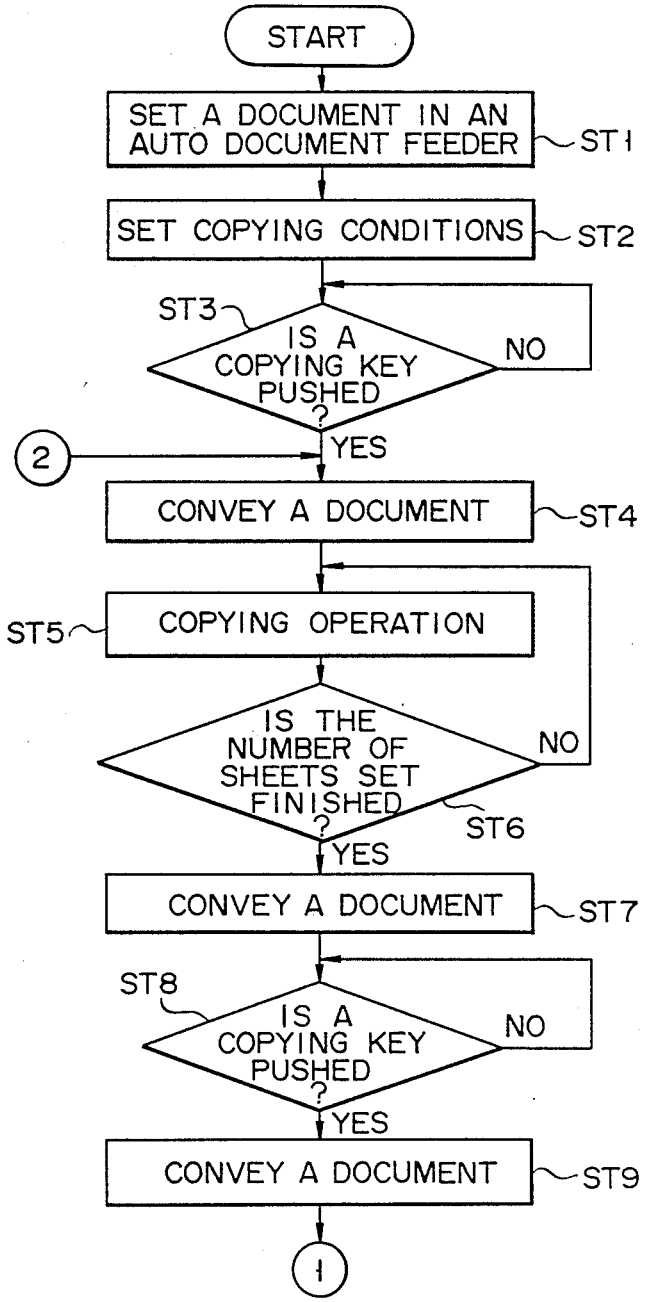
FIGS. 5A and 5B show a flow chart for explaining the operation of the machine of FIG. 1.
Figure 5B:
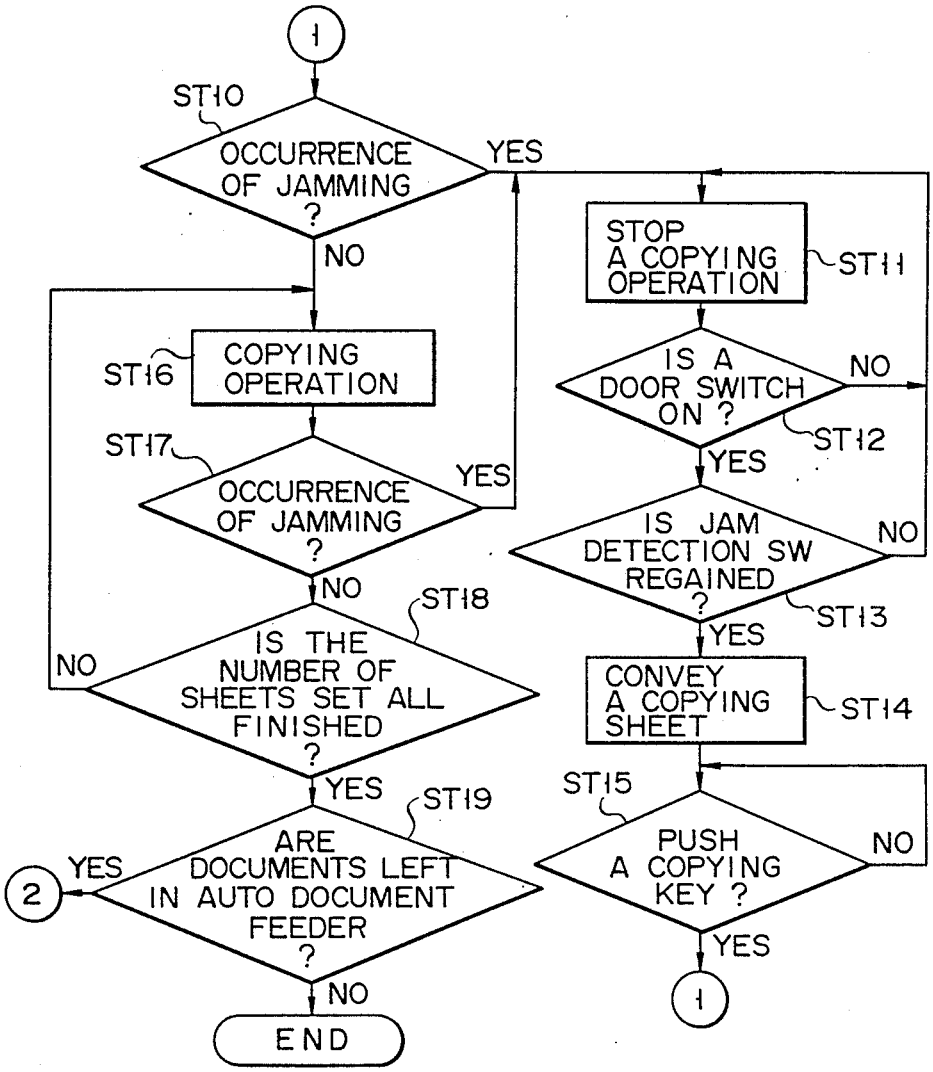

FIG. 4 diagrammatically shows the arrangement of the control system. A main controller 61 controls all operations of the copying machine and is connected to the aforementioned operation panel 30, copying unit 3, two-sided/multiple copy unit 27, auto document feeder 28, door switch 42, jam detection switches 55 and 56 including the aforementioned passage switches 54 and 57, memory (ROM) 63 for storing a control program, and memory (RAM) 64 for storing, for example, the number of copying sheets.

The aforementioned controller 61 is mainly constructed of a microcomputer and its associated peripheral circuits and operated in accordance with a program which is stored in the memory (ROM) 63. A driver 270 for a motor 27N which drives pairs of conveying rollers 27H, 27J, 27L, etc., is provided in the two-sided/multiple copy unit 27N.

The operation of the copying machine will be explained below with reference to the accompanying drawings.

A plurality of document sheets with, for example, an image copied at one side are set on the document feed rest 281 of the auto document feeder 28 at step ST1. For example, the copy magnification, the sheet size, the number of copying sheets, etc., are set on the operation panel 30 and, at the same time, the operation key 308 corresponding to the two-sided copy is operated at step ST2. Then the auto two-sided/multiple copy mode for automatically copying a document image on each side of the sheet is set and the number of copying sheets set is stored in the memory (RAM) 64.

If the copying key 30A is operated in this state —step ST3—, the auto document feeder 28 is operated, causing one of document sheets which are set on the document feed rest 281 to be picked up by the conveying section 282 and conveyed to a set position on the document table 2 at step ST4.

With the document sheet so set on the document table, the copying unit 3 is operated, starting a copying operation at step ST5. That is, the exposure lamp 4 is lit and the document on the document table 2 is scanned with the optical system, allowing a document image to be imaged on the surface of the photosensitive drum 10 which is initially charged by the charger 11. The document image is developed by the transfer charger 12 into a toner image. The toner image is transferred to one side of the sheet which is taken out of any one of the sheet feed cassettes 131, 132 and 133 by means of the transfer charger 18 and supplied via the resist roller pair 17. The toner image sheet is fed via the discharger 19 and conveying belt 20 to the fixing roller 21 where it is fixed. The toner image-fixed sheet is sent via the pair of delivery rollers 22 and gate 26 to the two-sided/multiple copy unit 27 and stored into the stacking section 27A via conveying path 27B.

In this way, the plurality of sheets which are set at step ST2 are sequentially copied in a way as set forth above and stored all in the stacking section 27A with an image formed on one side of the sheet at steps ST5 and ST6. If step ST6 determines that the copying operation is completed for the plurality of sheets whose data is stored in the memory 64, then the sheets which are stored within the stacking section 27A is aligned with one another. That is, those sheets which are stored in the stacking section 27A are moved with a movement of the length guide 51 in accordance with the sheet size and pushed by the side aligning rollers 53, 53 against the width guide 52 to secure a sheet alignment.

At the conclusion of copying of the sheets, one of the sheets which are stored in the stacking section 27A is taken out for the other side of the sheet to be copied, and then conveyed near the transfer section of the copying unit 3—step ST7. That is, the control gate 27I is in the state as indicated in FIG. 2 and the sheet is taken out from the topmost of the sheet stack in the stacking section 27A and fed via the pair of separation rollers 27H to the control gate 27I. When the leading edge of the sheet is detected by the passage detection switch 54, the conveying rollers 27L are driven in such a direction as to feed the sheet to the inverting section 27M, while the pick-up roller 27G is being raised out of engagement with the sheet. The sheet which is guided into the control gate 27I is guided by the conveying rollers 27L toward the inverting section 27M. When the trailing edge of the sheet is detected by the passage detection switch 55, the conveying rolls 27J are operated, causing the control gate 27I to be rotated in a direction as indicated by T in FIG. 2 so that the conveying rollers 27L are rotated in a direction opposite to the aforementioned rotation direction. The inverted sheet is guided into the resist rollers 17 via the passage detection switch 56 and conveying path 27K. When the leading edge of the sheet is detected by the passage detection switch 57, the conveying rollers 27J, etc. are stopped and hence the sheet is stopped at that position. In this state, the copying key 30A on the operation panel 30 is held until it is operated.

If, in this state, the copying key 30A is operated at step ST8, the auto document feeder 28 is operated. A document sheet which is set on the document table 2 is delivered onto the document delivery tray 84 and the next document sheet is picked up from the document feed rest 281 and conveyed to the set position on the document table 2 at step ST9.

Step ST10 determines the state of the output signal of jam detection switches 55 and 56 to see whether or not "sheet jamming" occurs during transport. That is, if the sheet fails to be detected by the passage detection switch 56 a predetermined time after the leading edge of the sheet has been detected by the passage detection switch 55, the main controller 61 determines the occurrence of the "sheet jamming", thus inhibiting the copying operation. That is, the copying operation of the copying unit 3 is stopped and, at the same time, a display section 30C of the operation panel 30 display a "sheet jamming" state.

At step ST11, the "sheet jamming" state is released in accordance with a corresponding message on the display section 30C. That is, when the doors 1A and 1B are opened, the sheet caught on the conveying path 27K is removed from the copying machine. When the doors 1A and 1B are closed by the operator, the door switch 42 detects the closure of the doors 1A and 1B at step ST12 and the output signal of the jamming detection switches 55 and 56 regains its usual state at step ST13. For example, the fixing roller 21 in the copying unit 3 reaches a predetermined temperature and is returned back to a "copyable" state until which the sheet is picked up from the stacking section 27A of the two-sided/multiple copy unit 27 and conveyed to a location near the resist rollers 17 (step 14). That is, as set forth above, one sheet is taken out of the stacking section 27A, inverted at the inverting section 27M, conveyed near the resist rollers 17 and stopped.

If, in this state, the copying key 30A is operated at step ST15, control is transferred to the aforementioned step ST10 where it is determined whether or not the sheet is caught in transit. If, in this case, the occurrence of the "sheet jamming" is again detected, steps 11 to 15 are carried out in a repetitive fashion.

In the case where, at step ST10, there occurs no "sheet jamming", that sheet which is stopped near the resist rollers 17 is conveyed by the resist rollers 17 to the transfer section where a document image is copied on the other side of the sheet. In this case, the sorting gate 26 is rotated toward a position leading to the tray 24 and the sheet which is copied on each side is delivered onto the tray 24 via the sorting gate 26.

During the period of time in which the document image is copied, the next sheet is conveyed from the stacking section 27A to the location near the resist rollers 17. When, at this time, step ST17 detects the occurrence of "sheet jamming" by the jam detection switches 55 and 56 during transport, the aforementioned steps 11 to 15 are carried out.

In this way, the document image is copied on the other side of the sheet which is sequentially picked up from the sheet stacking section 27A. This operation is continued until the number of sheets set at step ST2, excluding the caught sheet or sheets, is copied—steps ST16 to 18. Upon the completion of the copying of all the sheets on each side, the document sheet in the set position is delivered by the auto document feeder 28 onto the document delivery tray 284 and it is determined whether or not any document sheet or sheets are left on the document feed rest 281—step ST19. As a result, if the document sheet or sheets are left on the document sheet rest 281, steps ST4 to 19 are carried out and, if otherwise, the auto two-sided copy operation is completed.

According to the aforementioned embodiment, if the copying operation is interrupted due to, for example, the "sheet jamming" and it is detected that the sheet jamming is released at a later time, then one sheet is taken from the stacking section 27A and conveyed to the location near the transfer section of the copying unit 3 in readiness for the next operation, until the copying unit 3 is placed in an operable state. It is thus possible to reduce a time from the releasing of the "sheet jamming" to an initial copying operation.

In the aforementioned embodiment, even if a long distance is left from the stacking section 27A to the copying unit 3, a copying operation can promptly be started in accordance with a copying start instruction. Thus the present embodiment has been proved effective in particular.

Although the present invention has been explained above in connection with copying a document image on each side of the sheet, it can equally be applied to a "multiple copy" mode.

The present invention can be variously changed or modified without departing from the spirit and scope of the present invention.

What is claimed is:

1. A control apparatus for a conveying unit which stacks sheets in a stacking means, each sheet having an image formed on one side thereof, and conveys the stacked sheets to an image forming means via a conveying path, the control apparatus comprising:

first detecting means for detecting a sheet flow abnormality during conveyance of the sheets via the conveying path;

second detecting means for detecting removal of the abnormality detected by the first detecting means; and means for conveying the next sheet in the stacking means into proximity with the image forming means before the image forming means forms a further image on the sheet when the second detecting means detects removal of the abnormality.

2. The control apparatus according to claim 1, further comprising means for generating an instruction for starting image formation by the image forming means, wherein said conveying means comprises:

means for picking up the copying sheet the rest of said copy sheets held in said stacking means;

conveying rollers for conveying the copying sheet which is picked up by the pick-up means;

detecting means, provided near said image forming means, for detecting the copying sheet which is conveyed by the conveying rollers; and means for driving and stopping the conveying rollers, said driving/stopping means stopping the conveying rollers when the sheet is detected by the first detecting means, and driving the conveying rollers in accordance with said instruction.

3. The control apparatus according to claim 1, further including a door means, said second detecting means determining if the door means is opened or closed.

4. An image forming apparatus for forming images on sheets, each sheet having an image on one side thereof, comprising:

means for forming images on sheets;

means for stacking sheets bearing such images;

means for conveying the stacked sheets to the image forming means;

first detecting means for detecting a sheet flow abnormality during conveyance of the image formed sheets;

second detecting means for detecting removal of the abnormality;

means for generating instructions for starting image formation by the image forming means;

first controlling means for controlling the conveying means to convey the next sheet from the stacking means into proximity to the image forming means when removal of the abnormality is detected by the second detecting means;

second controlling means for controlling the conveying means to stop conveyance of the next stacked sheet when said sheet comes into proximity with the image forming means; and third controlling means for controlling the conveying means to convey the stopped sheet to the image forming means when the instruction is generated by the generating means.

5. The image forming apparatus according to claim 4, wherein said conveying means comprises:

means for picking up said sheet held in said stacking means;

conveying rollers means for conveying the sheet which is picked up by the pick-up means;

means, provided near said image forming means, for detecting the sheet which is conveyed by the conveying rollers; and means for driving and stopping the conveying rollers, said driving/stopping means stopping the conveying rollers when the sheet is detected by detecting means, and driving the conveying rollers in accordance with said instruction.

6. The image forming apparatus according to claim 4, wherein said conveying means comprises:

means for inverting said image-formed sheet picked up from said pick-up means; and gate means for guiding the sheet which is picked up by the pick-up means onto either one of said image forming means and said inverting means.

7. The image forming apparatus according to claim 4, further including door means, said second detecting means situated to detect if the door means is open or closed.

* * * * *